US007841950B2

(12) United States Patent
Davidson et al.

(10) Patent No.: US 7,841,950 B2
(45) Date of Patent: Nov. 30, 2010

(54) PRODUCTS AND METHODS FOR OCULAR ENHANCEMENT AND METHODS FOR CONDUCTING BUSINESS THEREBY

(76) Inventors: Thomas Davidson, 24223 47th Ave. SE., Woodinville, WA (US) 98072; Clifford Davidson, P.O. Box 1832, Bothell, WA (US) 98041

( * ) Notice: Subject to any disclaimer, the term of this patent is extended or adjusted under 35 U.S.C. 154(b) by 0 days.

(21) Appl. No.: 11/205,288

(22) Filed: Aug. 16, 2005

(65) Prior Publication Data

US 2006/0196490 A1 Sep. 7, 2006

(51) Int. Cl.
*A63B 69/00* (2006.01)
*F41B 11/00* (2006.01)

(52) U.S. Cl. ..... 473/51; 473/422; 124/56; 124/6

(58) Field of Classification Search ..... 473/422, 473/451, 431; 124/1, 6, 16, 78, 785; 434/247–254; 482/5, 110
See application file for complete search history.

(56) References Cited

U.S. PATENT DOCUMENTS

| | | | | |
|---|---|---|---|---|
| 3,584,614 | A | 6/1971 | Horvath | |
| 3,662,729 | A | 5/1972 | Henderson | |
| 3,855,988 | A | 12/1974 | Sweeton | |
| 3,905,349 | A | 9/1975 | Nielsen et al. | |
| 4,021,037 | A | 5/1977 | Torbet | |
| 4,027,646 | A * | 6/1977 | Sweeton | 124/56 |
| 4,091,791 | A | 5/1978 | Castelli et al. | |
| 4,207,857 | A | 6/1980 | Balka, Jr. | |
| 4,273,095 | A | 6/1981 | Speer | |
| 4,424,972 | A | 1/1984 | Vinette | |
| 4,442,823 | A * | 4/1984 | Floyd et al. | 124/78 |
| 4,991,838 | A * | 2/1991 | Groves | 473/451 |
| 5,437,261 | A * | 8/1995 | Paulson et al. | 124/78 |
| 5,464,208 | A * | 11/1995 | Pierce | 473/451 |
| 5,496,025 | A * | 3/1996 | Phillips et al. | 124/56 |
| 5,507,271 | A | 4/1996 | Actor | |
| 5,711,725 | A * | 1/1998 | Bengtson | 473/451 |
| 5,771,621 | A | 6/1998 | Rogers | |
| 5,823,894 | A * | 10/1998 | Actor | 473/422 |
| 6,237,583 | B1 * | 5/2001 | Ripley et al. | 124/78 |
| 6,447,408 | B1 | 9/2002 | Bonaventura | |
| 6,612,942 | B1 * | 9/2003 | Battersby et al. | 473/451 |
| 6,918,843 | B1 | 7/2005 | Franssen | |
| 2002/0111231 | A1 | 8/2002 | Bonaventura | |
| 2003/0004016 | A1 | 1/2003 | Bonaventura | |
| 2003/0101978 | A1 * | 6/2003 | Smith et al. | 124/69 |

OTHER PUBLICATIONS

Internet download—CSI. Cannon Sports—Jul. 20, 2005.
Internet download—Batting Cages, Inc. (BCI)—Jul. 20, 2005.
Internet download—Survival Research Labs (SRL)—Jul. 20, 2005.
Internet download—OIPSports.com—Jul. 20, 2005.
Internet download—TheSportCatalog.com—HighlandSports Catalog—Jul. 20, 2005.
Internet download—BaseballTips.com—Jul. 20, 2005.
Internet download—HitRunScore.com—Jul. 20, 2005.

* cited by examiner

*Primary Examiner*—Mitra Aryanpour
(74) *Attorney, Agent, or Firm*—Ladas & Parry LLP; John P. Luther

(57) ABSTRACT

The present invention provides methods and products effective for ocular enhancement conditioning of users attempting to successfully hit or otherwise make contact with objects projected towards, away from or at angles by the users, and increasing efficacy in hitting and contact.

15 Claims, 5 Drawing Sheets

PRODUCTS AND METHODS FOR OCULAR ENHANCEMENT AND METHODS FOR CONDUCTING BUSINESS THEREBY

COPYRIGHT NOTICE

Copyright 2005 Thomas E. Davidson and Clifford W. Davidson. All rights reserved. A portion of the disclosure of this patent application/patent document contains material which is subject to copyright protection. The copyright owners have no objection to the facsimile reproduction by anyone of this document or patent which issues therefrom as it appears in the United States Patent and Trademark Office file and records.

FIELD OF THE INVENTION

The present invention relates to products and methods effective for ocular enhancement conditioning of baseball players, tennis players, hockey players, skeet shooters and others engaged in various sporting and hunting activities and an array of products and combinations of products for use in such conditioning.

BACKGROUND OF THE INVENTION

Ball pitching devices have been used for a variety of purposes, including tennis and other racket sports, baseball, softball and so on. Uses with respect to tennis have included practice returning the balls that are propelled towards a tennis player. Ball pitching devices have also been used in baseball for batting practice, and have more recently been used in training wherein a user is to maintain visual contact with the ball. There are other uses for ball pitching devices, including catching practice and fielding practice, to name just a few.

There have recently been provided training programs and methods, including ball pitching devices and the like, which are said to enhance the performance of athletes, including ocular conditioning programs devised to subject an athlete to exaggerated conditions, or such conditions which athletes would seldom ever encounter during normal competitive environments. The theory behind such exaggerated training programs is that after being continually subjected to extreme conditions an athlete will be better prepared physically and mentally to perform under normal or less extreme competitive conditions.

For example, exaggerated conditioning training programs are commonly used in baseball where bat speed is crucial to successfully hitting the ball. Before stepping into a batter's box to face live pitching, the batter will swing two or three baseball bats, or swing a single bat having a weight or "doughnut" slid down around the barrel of the bat. When the batter steps into the batter's box to face a pitcher, the batter's muscles are conditioned to swing a heavier bat. Accordingly, when the batter swings a lighter bat, such as one without a practice donut and the like, the conditioned muscles and will usually propel the bat at greater speed. Typical batting practice or even the events occurring during a live baseball game where a variety of styles of pitches are thrown are other examples to a limited degree. More appropriate examples, however, may be batting cages where the speed of a ball is propelled at a user at selected initial speeds that the user is generally comfortable with and able to hit the balls. The speed is then routinely increased to a point, oftentimes in the extreme, where the user finds that hitting balls becomes difficult, or virtually impossible. At this point, the user will routinely slow down the ball speed to resume hitting and in many circumstances finds that hitting balls at the initial speeds or thereabouts has now become easier through the conditioning of previously trying to hit the balls at higher speeds.

In like manner, as described, for example, in U.S. Pat. No. 6,447,408, such methods of using extreme measures in the ocular conditioning of ballplayers is said to enhance their efficacy in baseball hitting. As described, there is provided a method for providing ocular enhancement for training a player of a game in which an object is projected towards the player at a predetermined first velocity range to increase the ocular focus of the player, and in which the method must be performed in a single training session. Further, the method comprises the steps of first providing an apparatus for sequentially varying the velocity of the projected object and for projecting a plurality of objects towards a player one at a time, then enhancing the ocular focus of the player by sequentially varying the velocity of a projected object during a single training session, wherein the step of enhancing the ocular focus comprises a plurality of sequential steps, the sequential steps comprising determining the first range of velocity, projecting a first set of the plurality of objects towards a player within the first range of velocity, subsequently increasing the velocity at which a second set of the plurality of objects is projected towards the player to a second velocity range which is greater than the first velocity range to increase the player's ocular focus at the second range of velocity, and then subsequently decreasing the velocity at which a third set of the plurality of objects is projected towards the player at a third velocity range which is within the first velocity range. See also, for example, U.S. Published patent application Ser. Nos. 2003/0004016 and U.S. Ser. No. 2002/0111231.

These methods as described, however, are merely nothing more than a known rendition of what has been practiced on playgrounds and in batting cages for years, or even that which occurs routinely during any live ball game; that is, one attempts to hit a ball at a comfortable speed and is successful, then the person increases the ball speed to an extreme degree, oftentimes at speeds at which the ball cannot be hit by the person, followed next by the person lowering the ball speed once again to a comfortable hitting speed. As to the critical limitation recited in these references that the method must be performed in "a single training session", nothing is mentioned or defined as to what a "single session" is or how one is to engage in a single session, or what advantages are to be gained therefrom. There is no guidance provided of how to practice a "single session" to reap the benefits of such a supposedly superior ocular conditioning. In short, to date nothing is taught or provided by the prior art or conventional methods of new and more effective ways to enhance ocular conditioning, except to propound what has been done for decades. Additionally, nothing is provided or mentioned in these methods as to apparatus and equipment for actually practicing the supposedly ocular enhancing methods As shown, there exists a long felt and much sought after need for more effective methods of ocular conditioning, as well as effective equipment to practice these methods to their fullest potential.

SUMMARY OF THE INVENTION

In accordance with the above, there is now provided in one aspect of the present invention a novel and superior method for providing ocular enhancement of a person, such as a baseball player, in which an object is projected towards the person, such as a baseball towards a batter, at various velocity ranges in succession to increase the ocular focus off the batter and the batter's efficacy in hitting the baseball at various speeds, and more preferably a batter's efficacy in successfully hitting a baseball at a variety of speeds and/or balls projected at the player in a variety of styles, such as curve balls, sliders, forkballs, fast balls and the like, and preferably to desired locations in a hitting field, i.e. ballpark. More particularly, in one preferred embodiment the present invention provides a method for ocular enhancement in the training of a player of a game in which an object is projected towards the player at differing velocity ranges, and in which the player is a baseball player with a plurality of balls being projected at the player in a single session, which session preferably comprises a ball being projected about every 3 to 5 seconds towards the player for approximately 20 to 80 balls substantially without interruption, optionally in different batches of styles of pitches, or alternating styles of different pitches. The inventive method further comprises projecting a set of balls toward the player at a first velocity range, then subsequently increasing the velocity to a second velocity range greater than the first velocity range at which a second set of balls is projected towards the player and which is effective to enhance the ocular focus of the player in the second velocity range, then subsequently decreasing the velocity to a third velocity range lower than the second velocity range, optionally within the first velocity range, at which a third set of balls is projected towards the baseball player and which is effective to enhance the ocular focus of the player in the third velocity range.

In other preferred aspects of the invention, there is provided a novel and superior ball projecting apparatus for practicing the inventive method, and also novel and exceptionally effective baseball practice bats for exploiting the benefits and advantages of the present invention, or for use alone to increase batting efficacy.

In yet further aspects of the present invention, there are provided novel and efficacious methods in similar manner to the above-described ball hitting exercise for employing the inventive ocular enhancement methods in engaging in a variety of sporting and hunting activities, such as for tennis players, hockey players, football players, rebounds for basketball players, cricket players, ping-pong players, fielding exercises for ball players, and even skeet shooters, or virtually any activity in which enhanced ocular focus abilities result in enhanced performance.

The present invention with its wide array of practical embodiments and applications will be better understood with reference to the following Detailed Description of Preferred Embodiments with accompanying drawings and claims.

DETAILED DISCUSSION OF PREFERRED EMBODIMENTS

Figure 1:
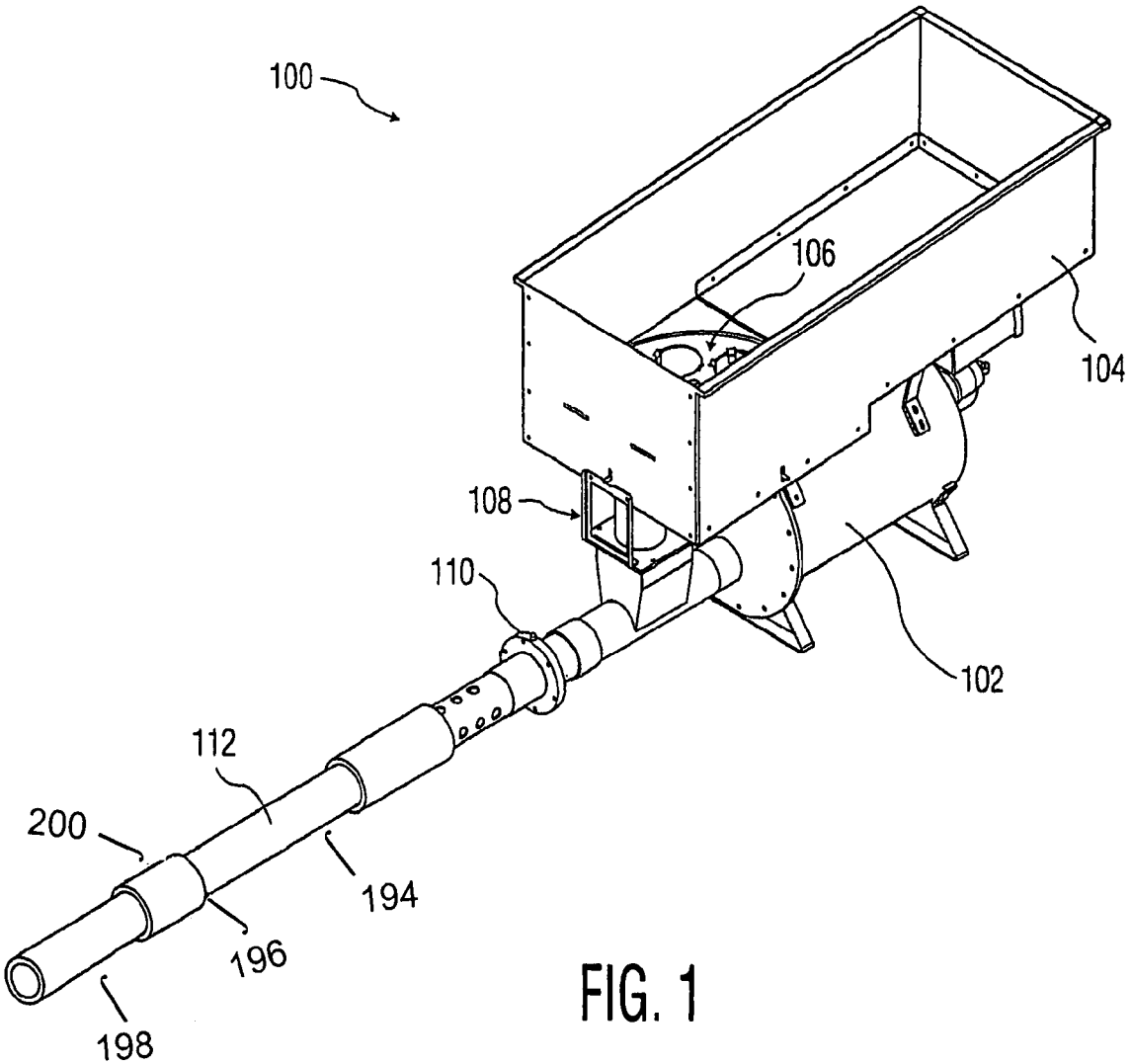
FIG. 1 is an illustration in perspective view of a preferred embodiment of a ball projecting apparatus which is preferred for use in the ocular enhancement method of the present invention.

All patent references, published patent applications and literature references referred to or cited herein are expressly incorporated by reference to the same extent as if each were specifically and individually indicated to be incorporated by reference. Any inconsistency between these publications and the present disclosure is intended to and shall be resolved in favor of the present disclosure.

In the following discussion, many specific details are provided to set forth a thorough understanding of the present invention. It will be obvious, however, to those skilled in the art that the present invention may be practiced without the explicit disclosure of some specific details, and in some instances of this discussion with reference to the drawings, known elements have not been illustrated in order to not obscure the present invention in unnecessary detail. Such details concerning computer networking, software programming, telecommunications and the like may at times not be specifically illustrated as such are not considered necessary to obtain a complete understanding of the core present invention, but are considered present nevertheless as such are considered to be within the skills of persons of ordinary skill in the art.

It is also noted that, unless indicated otherwise, many functions described herein with respect to ball pitching apparatuses may be performed in either hardware or software, or some combination thereof. In some preferred embodiments the functions may be performed by a processor, such as a computer or an electronic data processor, in accordance with code, such as computer program code, software, and/or integrated circuits that are coded to perform such functions.

Furthermore, the following discussion is for illustrative purposes only, and discusses the present invention in reference to various embodiments which may perhaps be best utilized subject to the desires and subjective preferences of various users. One of ordinary skill in the art will, however, appreciate that the present invention may be utilized in a great variety of forms in promoting ocular enhancement and developing superior skills in a variety of sports and exercises.

Having thus prefaced this discussion, in a preferred embodiment the present invention provides a novel and superior method of providing ocular enhancement to a person, such as a baseball player, in which an object is projected towards the person, such as a baseball towards a batter, at various velocity ranges in succession to increase the ocular focus of the batter and the batter's efficacy in hitting a baseball at various speeds, and more preferably a batter's efficacy in successfully hitting a baseball at a variety of speeds and/or balls projected at the player in a variety of styles, such as curveballs, breaking balls, fastballs and the like, and preferably to desired locations in a hitting field, i.e. a ballpark. More particularly, in a preferred embodiment the invention provides a method for providing ocular enhancement in the training of a player of a game in which an object is projected towards the player at differing velocity ranges, and in which the player is a baseball player with a plurality of balls being projected at the player in a single session, which session preferably comprises a ball being projected approximately every three to five seconds towards the player for approximately 20 to 80 balls without interruption, or at least without substantial interruption, optionally in different batches of styles of pitches, or alternating styles of pitches and the like, such as fast balls, breaking balls, sliders and so on. In this preferred embodiment, the method further comprises projecting a set of baseballs toward the player at a first velocity range, then subsequently increasing the velocity to a second velocity range which is greater than the first velocity range, and wherein a second set of baseballs is projected towards the player which is effective to enhance the ocular focus of the player in the second velocity range, and subsequently decreasing the velocity to a third velocity range which is lower than the second velocity range, optionally within the first velocity range, and in which a third set of baseballs it is projected towards the baseball player which is effective to enhance the ocular focus off the player in the third velocity range.

As used herein, the term "session" refers to a period of time, or frequency, in which a continuous succession, or substantially continuous succession, of a determined number of objects, such as balls, for instance, baseballs, tennis balls, foot balls and ping pong balls and the like, or skeet-shooting targets and the like, are projected in the general direction of a user, or at some angle by or across from a user or away from a user, as the case may be, at selected velocities. For instance, in the preferred embodiment of the baseball training example as described above, a session, that is, the frequency of projecting balls from a determined amount of balls, or the rate of continuous, or substantially continuous, ball pitching at a player for a given time at selected velocities in providing ocular enhancement, may be determined from a number of factors, such as a particular numerical session's effectiveness in enhancing efficacy in the hitting performance, and ocular enhancement, of a user. Thus, a session may be tied to an individual's particular desires or hitting ability, but for most purposes herein, a typical session in the context of ball hitting may range from an object being projected at a person from about every second or less to about every 60 seconds, and more preferably from about every 2 seconds to about every 10 seconds, and most preferably from about every 3 seconds to about every 5 seconds, from an allotment of from 2 up to about 500 or more objects or balls, all projected in a continuous, or substantially continuous, manner at selected projection velocities of objects or balls and the like, and wherein said velocities may be maintained, increased or decreased as desired. Of course, a session may be periodically temporarily or momentarily suspended to change velocities higher or lower as desired or prescribed by a hitting practice regimen, such as a few seconds or within a particular frequency range, or alternatively means may be employed to automatically change velocities higher or lower during the course of a session. Such means are known by those skilled in the art. Further, in accordance with the present invention, the velocity may be increased or decreased, as determined, for instance, by the user or a trainer who is monitoring one's ocular enhancement efficacy.

In some additionally preferred embodiments, the inventive method may be practiced with resulting successful ocular enhancement in only two velocity ranges of balls projected at a player, and which may comprise a first hitting speed, preferably a familiar hitting speed, again, optionally in conjunction with a variety of different styles of pitches and/or to different field positions, and in a defined session, say, a pitched or projected ball approximately every 3 to 5 seconds for a set of balls, for example, of 20 to 80 balls, in an uninterrupted or continuous, or substantially continuous, manner, then followed by a second hitting speed, which may vary from essentially 1 or 2 miles per hour greater than the first hitting speed up to in excess of 150 miles per hour greater, and preferably, for most purposes, from about 5 to about 15 miles per hour greater, and optionally in conjunction with a variety of different styles of pitches and/or to different field positions, and also in a defined session, such as a pitched or projected ball at the batter about every 3 to 5 seconds for a total of 20 to 80 balls, and again in an uninterrupted manner.

This preferred embodiment may also be practiced with resulting successful ocular enhancement with a plurality of incrementally increased or increasing (and/or decreasing) velocity ranges of projected objects or balls, for example, from 2 to in excess of 1,000 or more velocity range increments (2 plus n, where n is an integer), optionally closely spaced, or more preferably in increasing or decreasing velocity increments of from about 2 to 5 or 6 mile per hour velocity ranges, and preferably from about 5 to 15 miles per hour velocity increment increases or decreases, and most preferably from about 10-15 miles per hour velocity increment increases or decreases, optionally in conjunction with a variety of different styles of pitches and/or to different field positions with each velocity range practiced in a defined session of frequency and quantity of projected balls or other objects in a continuous manner, up to a desired maximum, or down to a desired minimum velocity range.

In other preferred embodiments, the present invention is effective for training a user in any activity in which one or more objects are projected towards the user, away from the user, or at some angel by the user at differing velocity ranges comprising, (a) projecting a set of objects towards, away from or at some angle by the user at a first velocity range, then, (b) projecting a set of objects towards, away from or at some angle by the user at a second velocity range greater than the first velocity range, and effective to enhance the ocular focus of the user as to the projected objects in the second velocity range, and, (c) wherein steps (a) and (b) are carried out in substantially continuous succession within each velocity range, and being performed in a session comprising an object being projected from about every 2 seconds to about every 60 seconds with a total of from about 2 objects to about 10,000 objects or more.

In still other preferred embodiments, the present invention is effective for training a user in any activity in which one or more objects are projected towards the user, away from the user, or at some angle by the user at differing velocity ranges comprising, (a) projecting a set of objects towards, away from or at some angle by the user at a first velocity range, then, (b) projecting a set of objects towards, away from or at some angle by the user at a second velocity range greater than the first velocity range, and effective to enhance the ocular focus of the user as to the projected objects in the second velocity range, (c) wherein steps (a) and (b) are carried out in substantially continuous succession within each velocity range and from one velocity range to another, and being performed in a session comprising an object being projected from about every 2 seconds to about every 60 seconds with a total of from about 2 objects to about 10,000 objects or more, and (d) wherein step (b) is optionally followed by an additional step in projecting a third set of objects towards, away from or at some angle by the user at a third velocity range selected from that of lower than the second velocity range and within the first velocity range, and effective to enhance the ocular focus of the user as to projected objects in the third velocity range.

In still yet other preferred embodiments, the present invention is effective for training a user in any activity in which one or more objects are projected toward the user, away from the user, or at some angle by the user at differing velocity ranges comprising, projecting a set of objects towards, away from or at some angle by the user in sets of a plurality of incrementally increasing velocity ranges, wherein said incrementally increasing velocity ranges are increased from about 2 to about 100 miles per hour per set of projected objects and effective to enhance the ocular focus of the user as to projected objects in each velocity range, and wherein objects are projected in substantially continuous succession within each velocity range and from one velocity range to another at frequencies of projection from about every 2 seconds to about every 120 seconds, with a total of from about 2 to about 10,000 objects or more.

As also contemplated in the inventive methods, and in any of the exemplified embodiments above, there may be interdispersed steps of projecting objects of incrementally decreasing velocity ranges of from about 2 to about 100 miles per hour or more per set of projected objects in substantially continuous succession, within each velocity range and from one velocity range to another as desired, or perhaps found most effective for the individual user for the provision of a custom tailored training regimen.

As may be appreciated by those skilled in the art, in such preferred embodiments with session-based incremental approaches to velocities, the inventive ocular enhancement method may be employed or practiced with a user to train to successfully hit baseballs, or to train to successfully make contact with other objects as desired, such as, for example, tennis balls, soccer balls, as in kicking, catching, head butting, and fielding, ping pong balls, squash balls, hockey pucks, air hockey pucks, receiving basketball rebounds, fielding baseballs, catching foot balls, and the like, or for enhanced accuracy in shooting skeet or game or other targets and the like, at speeds or velocities that were previously thought to be more or less impossible or otherwise undoable for the user, or which the user was previously unfamiliar with.

Additionally, in practicing any of the preferred embodiments described above, the user may also attempt any strategy or engage in any number of activities which mimics a bona fide activity, such as in a baseball game in not attempting to hit a first number of pitches or moving objects, but focusing and training one's eyes to follow the propelled objects on their trajectories for a time, e.g. to size up the velocity range or style of pitch (such as taking strikes) and actually watching the ball from its release through its path over the plate, or timing one self for enhanced hitting. A user may also employ any desired striking or batting position, such as a bunting position, optionally with each activity taking place within a given session.

Still further, projected objects, such as any type of balls, for instance, baseballs or tennis balls and the like, may be color coded, such as for different speeds/velocities, or for different sessions, or perhaps for split or fractionated sessions for greater flexibility in ocular conditioning training, or there may be markings on projected objects, such as numbers and the like, or the face of a much disliked umpire, peer or owner, or competing team.

The inventive ocular conditioning may even take place with different sound environments, such as to concomitantly condition a batter, or tennis or hockey player, or football and basketball players to stadium sounds while attempting to hit at greater velocities, or a ballplayer in hitting a variety of different types of pitches, or to otherwise compensate or condition a user for the "distraction factor" while engaging in attempts to strike, hit or otherwise make contact with objects.

In a further aspect of the invention there is provided a novel ball projecting product and apparatus for use with some preferred embodiments of the invention. Ball pitching devices have been used for a variety of purposes, including baseball, tennis, softball and so on. Uses with respect to tennis have included practice returning projected balls, while such devices used in baseball are typically used in batting or fielding practice, or in a playground setting or perhaps at a fair, and have more recently been used for training batters, for example, in maintaining visual contact with a projected ball. Other uses for such apparatus have included catching practice and fielding practice, such as to hone the skills of an infielder, to name just a few.

Figure 2:
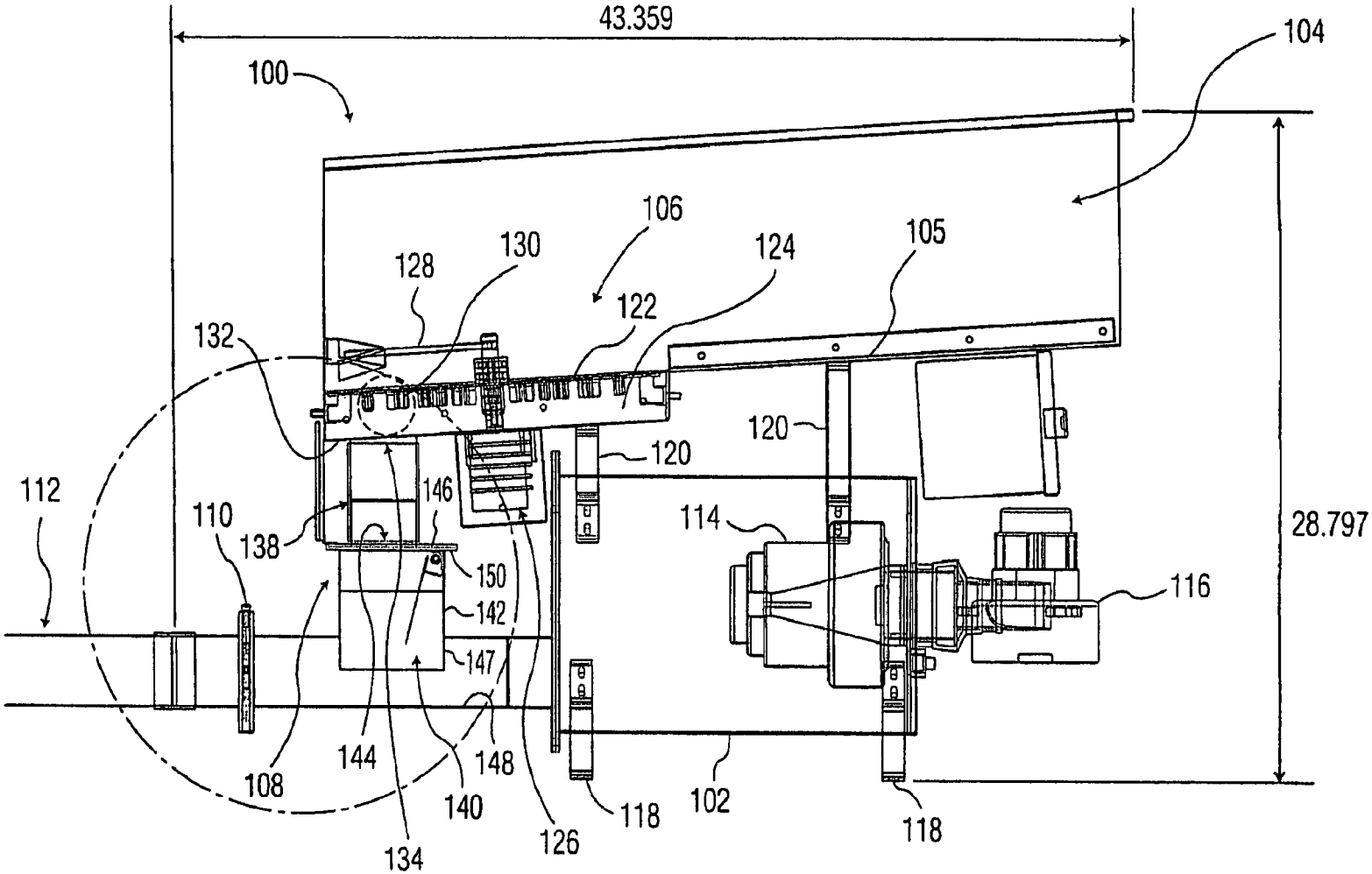
FIG. 2 is a partial cut-away side elevational view of the ball projecting apparatus of FIG. 1 showing various components thereof.

Turning now to FIGS. 1 and 2, in illustration of one preferred embodiment, a pneumatic ball pitching apparatus (100) is provided, which comprises a pressure vessel or tank means (102), a ball hopper means (104), a ball feed means (106), a ball loader assembly means (108), a restrictor means (110) and a barrel means (112). As shown, one or more compressors, (114, 116) may be mounted in fluid communication with a vessel or tank (102). One compressor (114) may be mounted internally of a pressure tank or vessel (102), and a second compressor (116) may be mounted externally of the tank (102). In this embodiment the two compressors (114, 116) are arranged in series such that the external compressor (116) compresses air from outside the tank and feeds it to the second compressor (114). The second compressor (114) further compresses the air and discharges it into the pressure tank or vessel (102). While any arrangement or method of air compression is contemplated for use in this invention, a two-stage compression, as illustrated, may be desired, as opposed to a single-stage compression, as being more efficient, and more economical as less energy consuming.

The pressure tank or vessel (102) may be supported by any arrangement of bracket means, such as bracket means (118) attached to a lower section or portion of the tank means (102). These brackets, in turn, may also be mounted to a stand or cart (not shown), or perhaps may be configured to rest on the ground or other support surface.

Ball hopper (104), configured to hold any amount of balls as desired, may be supported at a position above the tank (102) by means of a bracket arrangement (120), and preferably such that the bottom of the hopper (104) is inclined downward toward the end containing the ball feed means (106).

Figure 3:
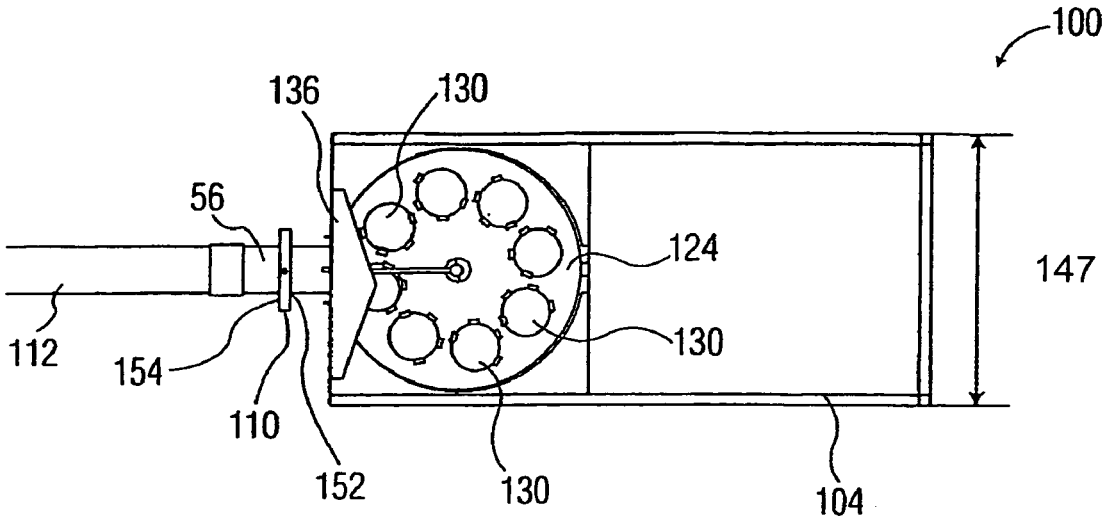
FIG. 3 is a plan view of the side elevational view of the ball projecting apparatus illustrated in FIG. 2.

With reference to FIGS. 1-3, the ball feed means (106) may be mounted or otherwise arranged in a juxtaposed fashion with the hopper (104), such that an upper surface (122) of a carousel means (124) for receiving, holding and carrying balls from the hopper (104) one at a time is at or below the level of the bottom (105) of the hopper (104). The carousel means (124) may be driven or set in movement, for example, by an electric motor (126) driven by batteries or other electric current, and the electric motor may be geared down by gear means (not shown) effective to rotate the carousel means (124) at a desired rotation speed, such as used in conjunction with a desired session or frequency of projection as described above. The rotation speed may be fixed or may be varied by a speed control means (not shown), as the case may be.

A ball agitator (128) is also preferably employed, and may be mounted coaxially with the carousel (124) and rotated by the motor (126), either together with the carousel (124) or at a rate different from the rotation of the carousel 124). In the latter case, the agitator (128) may be geared to the shaft of the carousel (124) so as to produce different rotation rates for the agitator (128) and the carousel (124). The agitator (128) may rotate in a plane parallel to, but spaced upwardly from, the upper surface (122) of the carousel (124). Rotation of the agitator (128) may facilitate entry of balls into apertures (130) situated on the upper surface (122) of the carousel (124). The size of the carousel apertures (130) may vary to accommodate different sizes of balls.

A pan (132) is mounted beneath the carousel (124) in a plane parallel to the surface (122) of the carousel (124), and spaced a suitable distance from the carousel (124) such that balls located in the apertures (130) are supported at a desired level relative to the carousel (124). The pan (132) is equipped with an outfeed aperture (134) positioned above the ball loader assembly (108). A shelf (136) may extend from the front wall of the ball hopper (104) over carousel (124) and the ball outfeed aperture (134) in the pan (132). The height of the shelf (136) above the carousel (124) may be chosen to impede more than one ball at a time from falling out of an aperture (130) and through the ball outfeed aperture (134) in the pan (132) when the aperture (130) in the carousel (124) is positioned over the ball outfeed aperture (134).

The rotation rate of the carousel (124) may be selected such that sufficient time passes from when an aperture (130) first passes over the ball loader assembly (108) to the second time an aperture (130) passes so that the compressors (114, 116) have sufficient time to pressurize the tank (102) to the desired pressure level and launch a ball before the next ball is positioned to fall into the ball loader assembly (108).

Figure 4:
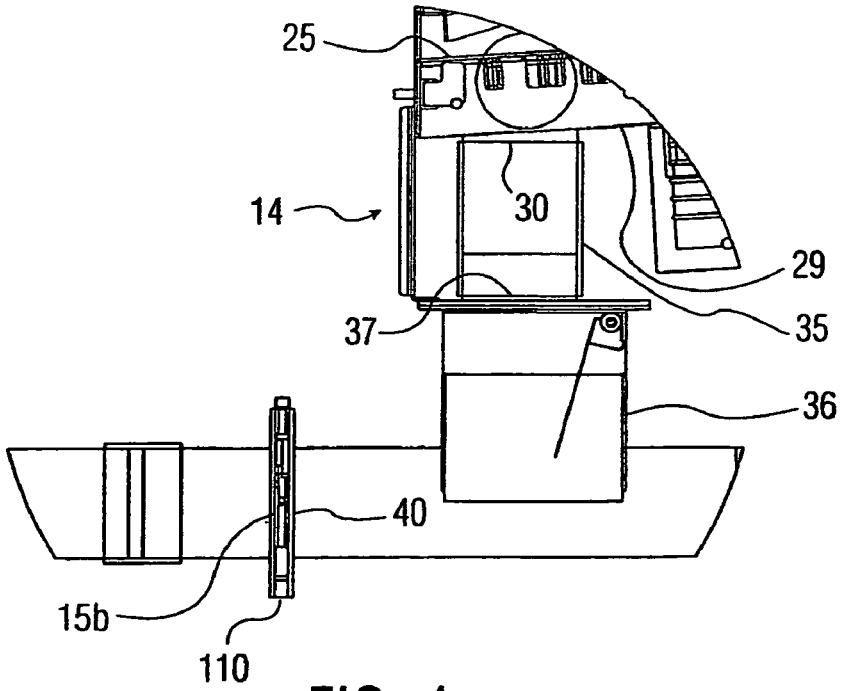
FIG. 4 is a cut-away side elevational view of a portion of the ball projecting apparatus illustrated in FIG. 2.

Referring to FIGS. 2 and 4, the ball loader assembly (108) may comprise a ball feed tube (138) that may be mounted on a flapper valve (140) housing (142). The ball feed tube (138) may extend all the way up to a lower surface of the pan (132), or it may be spaced apart from the pan (132). If desired, the ball feed tube (138) may not be used. The ball feed tube (138) may receive balls dropping through the ball outfeed aperture (134) in the pan (132), and may conduct the balls to an aperture (144) in the upper surface (146) of the flapper valve (140) housing (142).

The flapper valve (140) housing (142) may be mounted on an outfeed tube (148) that is connected to the tank (102). The upper portion (147) of the outfeed tube (148) may be cut away or otherwise removed such that a ball may fall through a ball outfeed aperture (134) into the flapper valve (140) housing (142) and then into the outfeed tube (148). Preferably, at least a portion of the ball feed tube (138) is composed of a transparent or see-through material, such as glass or Plexiglas and the like, which enables a would-be ball hitter to see the event of the ball to be projected "drop" into position from where it is propelled or projected at the user. This arrangement or feature has been unexpectedly found to provide distinct efficacy in hitting advantages, as users or players are able to adjust their timing in hitting by being able to watch or observe the drop of a ball, and to preferably hear sounds associated with the drop of a ball, and to adjust their individual timing accordingly, or otherwise to better find their individual rhythm such as to be better prepared to hit a propelled ball or object as the case may be. Some players or users have described such a sequence of events as mimicking a pitcher's wind-up, and which many base their timing on in successful ball hitting. These features and aspect of the invention are discussed in more detail below.

The flapper valve (140) may be mounted in the flapper valve housing (142) by a hinge means (150) which is effective to allow the flapper valve (140) to pivot into a position in which it covers a ball from the outfeed aperture (134) from entering into the flapper valve (140) housing (142). The flapper valve (140) may normally be in an open position when airflow is unrestricted through the outfeed tube (148) and barrel (112), and is normally closed when airflow from the outfeed tube (148) through the barrel (112) is restricted, and thus begins flowing upward through the outfeed aperture (134) in the flapper valve (140) housing (142). To facilitate closing of the flapper valve (140) under such conditions, a counterweight means, or spring means or other biasing mechanism (not shown) may be employed to partially bias the flapper valve (140) toward a closed position. The lower edge of the flapper valve (140) may also be extended into the outfeed tube (148) in flow communication with the tank (102) so that airflow through the outfeed tube (148) into the barrel (112) biases the flapper valve (140) toward a closed position in which it covers entry of a ball from the outfeed aperture (134) in the flapper valve (140) housing (142).

The flapper valve (140) is typically in its open position remote from the outfeed aperture (134) when flow of air through the restrictor (110) and barrel (112) is unobstructed. Thus, when a ball is positioned over the ball outfeed aperture (134) by the carousel (124), the ball travels along a feed path through the ball feed tube (138) and flapper valve (140) housing (142) and into the outfeed tube (148). Airflow from the tank (102) through the outfeed tube (148) then propels the ball toward the restrictor (110).

Figure 5:
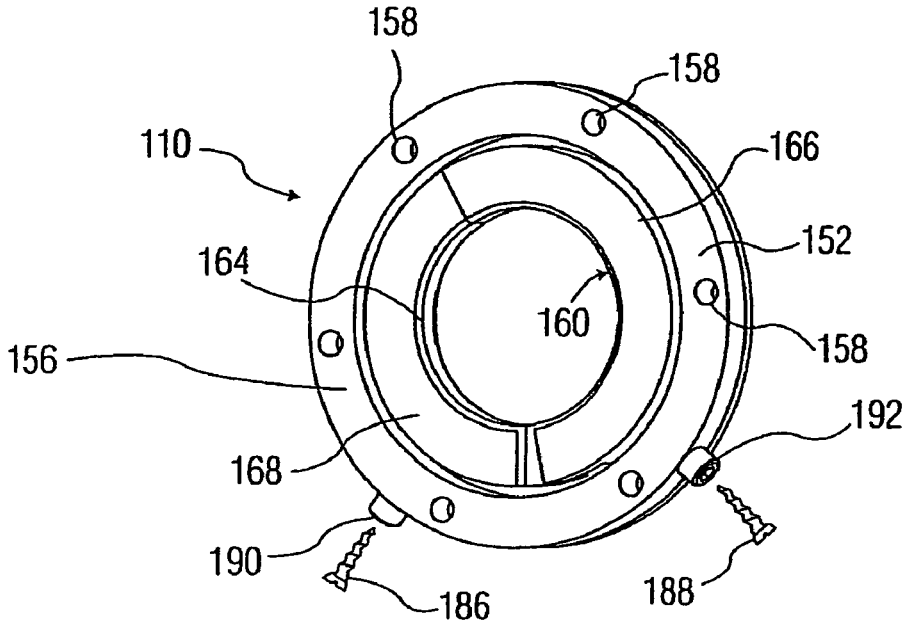
FIG. 5 is a side perspective view of an adjustable half-orifice component for use with the inventive ball projecting apparatus illustrated in FIGS. 1 and 2.
Figure 6:
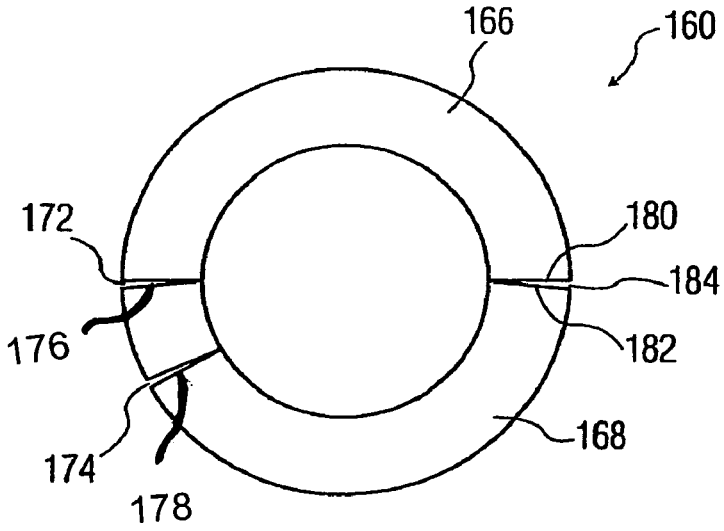
FIG. 6 is an exploded elevational view illustrating components of the orifice shown in FIG. 5.

The restrictor (110) may be situated between flanges (152, 154) on opposed ends of the barrel (112) and outfeed tube (148). The flanges (152,154) may be connected to one another by bolts or other fastening means extending through the flanges (152,154). As shown in FIGS. 4 through 6, the restrictor (110) includes a retaining plate or mounting plate (156) mountable between flanges (152,154). A series of holes or openings (158) may be spaced around the periphery of the retaining plate (156) of the restrictor (110) to allow the passage of bolts used to secure the flanges (152,154) together.

An orifice (160) may be mounted in the center of the retaining plate (156) and may be maintained therein by flanges (152,154). The orifice (160) may be made of any of a variety of materials having suitable strength and rigidity, including urethane rubber, other rubber material, plastics and metals, such as aluminum. The orifice (160) may be annular and have a central aperture (162) that is sufficiently small such that a ball may sit against it. The interior wall (164) of the orifice (160) that defines the orifice central aperture (162) may be chamfered, tapered, rounded or otherwise be formed to facilitate the seating of a ball against it.

The orifice (160) may be fixed or variable in dimensions. As shown in FIG. 6, a variable orifice (160) may comprise first (166) and second (168) semicircular portions that may be fitted together to form an annulus (170), and may include mating expansion tabs (172,174) at corresponding first ends (176,178) of each of the semicircular portions (166,168) that may be overlapped when the two semicircular portions (166, 168) are assembled together to form an annulus (170), allowing for expansion. The second ends (180,182) of the semicircular portions (166,168) may be configured to abut one another at the inside of the annulus (170) and to angle away from one another extending radially outwardly therefrom to form a wedge-shaped gap (184) when the orifice (160) is reduced in size. The size of the orifice (160) can thus be adjusted by moving the first ends (176,178) of the two semicircular portions (166,168) toward or away from one another, while the second ends (180,182) remain in contact with one another.

Two set screws (186,188) may be threaded into radially-extending threaded holes (190,192) that may be formed in the retaining plate (156). The set screws (186,188) may be threaded into the holes (190,192) and may contact the outer walls of the semicircular portions (166,168) of the orifice (160) to control the degree to which the orifice (160) is open or closed.

As mentioned above, flanges (152,154) may be secured to one another by bolts extending through holes (158) in the retaining plate (156), thereby mounting the barrel (112) on the pitching apparatus (100) and capturing the restrictor (110) within the orifice (160) in line with the outfeed tube (148) from the tank (102) as well as with the barrel (112).

In use, a ball after dropping is positioned within the restrictor aperture or ring with the flapper valve closed, and air pressure building up until sufficient to propel the ball through the restrictor ring, then through the barrel and in the direction intended. The split design of the restriction ring, as described above, with adjustment bolts to assist in speed control, has been found to provide unexpected advantages in ball speed control as it may be conveniently adjusted to reduce the amount of air pressure required to squeeze a ball through the restrictor ring. Only small adjustments may be required to drastically change speed control.

Additionally, it has also been unexpectedly found that by adjusting one screw relative to the other in varying amounts, a ball squeezing through the restrictor may be induced to travel a trajectory in the form of a curve or breaking ball, a fork ball, a rising ball, a cutter or other trajectories.

The barrel (112) is preferably tubular and may have an interior diameter sized to allow passage of a ball of the desired dimensions. In one embodiment, the barrel comprises a first tube section (194) on which a flange (196) is mounted. This first tube section (194) may be connected to a second tube section (198) by a flexible coupling means (200) or other articulation to allow aiming of the barrel (112). The barrel (112) may be aimed manually or automatically, such as, by the use of an electric motor coupled to a servo means, and may be controlled or operated, for example, by radio control means or other automated means or remote control means, as desired. While shortening of the barrel may reduce speed, in general, a barrel length is designed to insure directional control of a propelled ball, and may be determined without undue effort.

As also contemplated herein, other feed mechanisms may be employed with the pitching apparatus (100), such as a screw drive feeder or a plunger that activates to move a ball into a flapper valve housing.

In use, the pitching apparatus (100) is generally aimed at a user, such as a baseball hitter/batter, or a tennis player. As to baseball use embodiments, the apparatus (100) may be aimed slightly upward to "pitch" a ball in an arc such as to mimic a "change-up style" of pitch, or be more directly aimed to facilitate a fastball pitch, or it may be aimed to pitch fastballs toward an inside corner, for example, to mimic the style of a certain pitcher. It is further contemplated that the barrel (102) may be modified as desired, for example, including one or more internal protrusions of varying geometric shapes near its ball exit point or other means to induce a spin or other movement to the ball as desired in order to mimic types of pitched balls, such as, for instance, in addition to a fast ball, a curve or breaking ball, a slider, cutter or a fork ball for practice hitting, or to propel different styles or types of "pitched" balls over a particular portion of a home plate, such an inside or outside corner, for realistic batting training. A library of different barrels with each employed for characteristic pitches may be stocked for training purposes, or a barrel modified for different types of pitches may be designed to be rotated into position with its particular geometry inducing the desired ball trajectory in accordance with a particular pitch desired.

The barrel (102) may also optionally be equipped with one or more holes in it allowing the escape of compressed air at differing rates which will effect the velocity of the a propelled ball or object. For instance, in operation one may cover one or more of the holes, for example, by a slide, which may be operated manually or automatically, such as by radio control, to maintain increased pressure in the barrel (102) as desired to provide for increased velocity of propelled objects, or leave more holes uncovered as desired to decrease velocity of propelled objects as desired, to quickly and efficiently provide any hitting pattern or session as desired.

Figure 7:
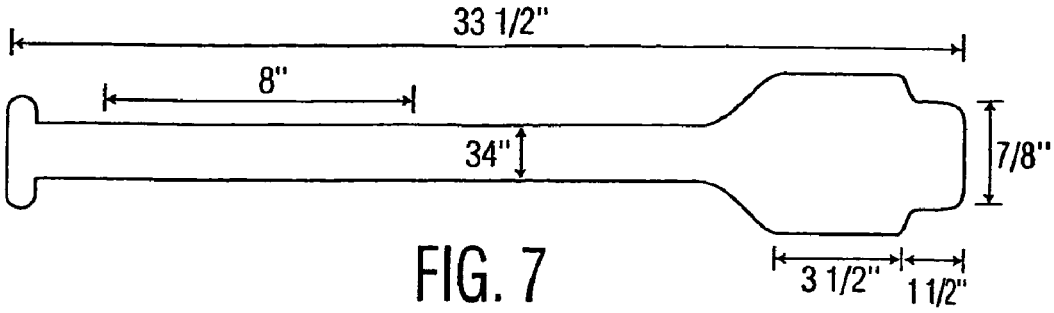
FIG. 7 is a perspective view of a preferred embodiment of a practice bat which may be used in the ocular enhancement method of the present invention.
Figure 8:
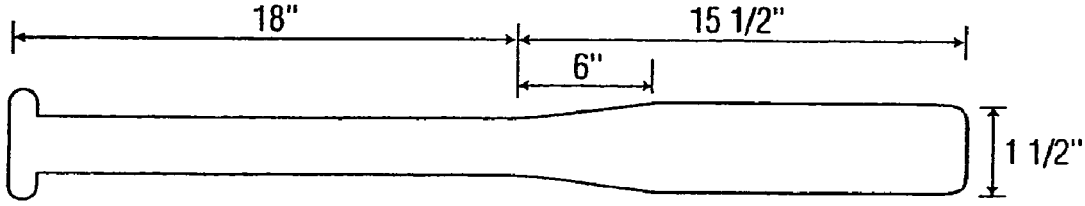
FIG. 8 is a perspective view of another a preferred embodiment of a practice bat which may be used in the ocular enhancement method of the invention.
Figure 9:
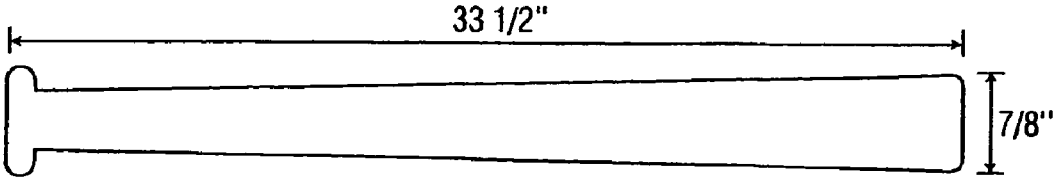
FIG. 9 is a perspective view of another preferred embodiment of a practice bat which may be used in the ocular enhancement method of the invention

In yet additional aspects of the invention, FIGS. 7, 8 and 9 illustrate in perspective views preferred embodiments of practice bats that may be used with the inventive ocular enhancement method, including the inventive pitching apparatus described above. As shown in FIG. 7, there is provided a training bat (200) which includes a barrel portion (202), a handle portion (204), a terminal hitting end (206) and a terminal hand holding end (208) which is finished with a cap portion, such as a typical baseball bat. The majority of the barrel portion (202) is preferably smaller proportioned than typical bats, such as would be, say, a 28 ounce bat, but contains as an integral portion a heavier bat section (210), say, as would be found on a 38 ounce bat, which is situated on the barrel portion (202) at a position most likely to make contact with a pitched or thrown ball, many times characteristic of an individual hitter, or otherwise a position oftentimes referred to as the "sweet spot" (shown generally as the 212 area). The sweet spot positioning of the heavier bat portion (202) may thus vary according to individual hitters, and therefore be custom fitted per hitter or player for even more effective enhanced ocular training as used with the present invention, or otherwise improved hitting efficacy.

FIG. 8 illustrates another embodiment of a practice bat (300) similar to that of the bat shown in FIG. 7, which comprises as an integral portion a heavier bat section (310) which is situated on a barrel portion (302) comprising the entire hitting end (306) of the barrel (303), and preferably inclusive of a contact/hitting sweet spot associated with virtually all, or substantially all, users of the bat (300).

FIG. 9 illustrates another preferred bat type which may be used with the present invention, which is relatively slim in dimension compared to typical ball hitting bats.

In other preferred embodiments and aspects of the invention, the ocular enhancement training methods may be employed, or otherwise designed, to counteract the effects of eye fatigue oftentimes encountered by ball hitters, or persons employing eye tracking of any type for any purpose, such as described herein, for example, baseball players, tennis players and the like. Such aspects and embodiments are perhaps best illustrated by way of some preferred examples of the inventive methods in operation. In one preferred exemplified embodiment, a process of "tracking", or ball or object watching by a user or player, is first undertaken and which is a period used to warm up a user or athletes and to train one's eyes to see and focus on a propelled object, preferably from the point of release to that, for example, of traversing home plate. Without intending to limit this invention to any specific or scientific theory, or other mode of action, it is thought that the longer a player has to observe a pitched ball or other propelled object, the more time the person has to adjust to seeing, and hitting or making some type of contact with it. To put it another way, some say adjusting to seeing (and hitting) a ball is the preferred route to just reacting to the ball. The former is said to make for great ball hitters, and the latter not so great hitters. Thus, tracking, as the term is used herein, is about picking up and observing the ball with one's eyes when the ball is released from the pitching machine, symbolized such as from the pitching mound, and preferably to keep the ball in the best field of view, such as, for example, within one's vision just prior to one's peripheral vision on either side, or vision elicited by stimuli falling on retinal areas distant from the macula or the small central area of the retina surrounding the fovea, the area of acute central vision, which is generally accepted as being from about 0 to about 20° from the center of one's eyes to either the nasal side or temporal side of the retina, or more simply, to keep one's nose on the ball. For instance, in accordance with this invention it is thought athletes or users who are able to see the ball from the release point to the catcher in one smooth motion, such as by practice of the inventive methods, will experience enhanced ball hitting ability at a variety of speeds. Such exercises carried out in conjunction with increased pitched ball velocities and decreased pitched ball velocities further enhances one's ball hitting efficacy. Additionally, colors or other markings, such as numbers, on pitched balls allow for the user, and also an observer or teacher of the inventive method, to determine how well the user or athlete is seeing pitched balls, as the greater the velocity at which numbers or colors are observed on pitched balls the easier it is for one to observe such at lower velocities. Such an exercise may be conveniently employed as a gauge of sorts to determine what exercises in accordance with invention are suited for a user. All of the above activities employed with a sense of timing, such as one being able to see and hear a ball drop inside a pitching machine into a position to be propelled at the user, then watching the ball on its trajectory in accordance with the invention enables the development of superior ocular enhancement and efficacy in hitting ability.

Further in accordance with that above, the following sequence of events is yet another preferred embodiment in the practice of the invention. First, in a tracking mode or step, a user or player will observe a first set of balls propelled at him/her, such as 60 balls, with every, say, $4^{th}$ ball increased in velocity, for instance, by 10 miles per hour, up to a maximum of, say, 130 miles per hour for any user or more, such as 160 miles per hour, for professional ball players. As described above, the barrel (102) is preferably equipped with a plurality of holes which can be covered manually, such as by an operator of the pitching machine using a slide mechanism, to increase air pressure in the barrel (102) as desired, and thus the velocity of propelled objects or balls which can then be propelled in faster increments. Thus, speed of propelled objects in this step may be increased exponentially as desired for custom designed tracking sessions, depending on the needs or desires of a user or player. In a next step, the pitching machine is stopped, sometimes for seconds or longer, but preferably for no longer than about from 2 to 5 minutes, or just long enough for the user to rest. This step is then followed by a focusing round where a set of balls is propelled at a user or player, say, another set of 60 balls, at a speed lower than the speeds employed in the first step or round. In this step, the user/player is asked to identify the numbers or markings on the pitched balls, referred to herein as "hard focus", in an exercise to determine how well one is seeing pitched or propelled balls. Once it is determined that the user is seeing pitched balls with a predetermined level of acceptable accuracy, say, 40-50%, then the next step is proceeded to in which the machine is again stopped, again, preferably for no longer than about from 2 to 5 minutes, or just long enough for the user to rest. A bunting round is then undertaken, again using, say, another charge of 60 balls, and takes place preferably from behind the plate, with ball velocities preferably somewhere in the range of that used in the focusing step. Optionally, a sub-step is employed herein with bunting taking place initially at lower ball velocities than that employed in the focusing step, say, at 50 miles per hour, and which velocities are incrementally increased in this step up to a maximum, such as 130 miles per hour for lay people and 160 miles per hour for professional ball players. In the next step, the machine is stopped again for a time, again, preferably not to exceed about from 2 to 5 minutes, or just long enough for the user to rest, after which a next hitting step is undertaken, again with, say, a charge of 60 balls, and preferably starting at ball velocities at or lower that that used in the focusing step, and preferably incrementally increased up to a speed of, say, 130 miles per hour for lay persons and 160 miles per hour for professionals. Optionally, one speed may be employed for a determined number of balls, then other sets propelled at increasing velocities, with an optional ceasing of operations between each step of from seconds to a couple minutes, depending on a players desires and/or performance level. Speeds may also be incrementally lowered as desired, or a mixed higher and lower set of speeds employed.

In still another example of a preferred embodiment, unexpected efficacy in ocular enhancement and hitting by implementation of the inventive methods and/or products has been found by employing a variety of ocular enhancement exercises in alternating fashion during the course of using one set of balls, such as from about 20 to about 180 balls, in enhancing a user's eye tracking of a ball to a bat, racket, or glove and the like. In this embodiment, in a first step, a user will visually track a group of balls, such as 10 balls, and then introduce a bat in a back bunting motion with the same motion in tracking the first group of balls, or within the same velocity and frequency of ball movement, and attempt to bunt balls 3 to 4 times in succession. This exercise has been unexpectedly found to provide superior results in helping athletes and users alike in directing and focusing their vision on a ball in its trajectory to the impact zone. In sub-steps, the user will then stop bunting, and revert back to eye tracking several more balls, again followed by bunting several more balls for a number of cycles as desired, for example 10 or more cycles. In a next step following the user's visual tracking of balls, the user will engage in a hitting drill within the approximate same ball propelling frequency and velocity for several swings, such as 2 to 5 swings of the bat or more, as desired, then followed by another round of visual tracking for, say 5 to 20 balls, then back to a hitting round for a determined number of balls, and the cycle repeated as desired. In further variations, an athlete or user may visually track, then bunt and then swing, in succession, or at determined intervals, and a particular pattern may be developed for a particular user's needs in enhancing ocular abilities and ball hitting efficacy. The above exercise may be conducted at incrementally increasing or decreasing ball projected frequencies and velocities as desired for even more enhanced ocular conditioning. As many have found it to be a natural reaction to look away from a ball when it gets close to a bat, or even to close one's eyes, such exercises as above-described have been found to eliminate or substantially curtail such tendencies in attaining superior ocular enhancement and ball hitting skills.

In yet still other embodiments, athletes and users alike may alternate between visual ball tracking, bunting and hitting, or engage in any desired cycles of various ball projected frequencies and velocities, such as, for instance, hitting one or more or a couple of balls again, then visually tracking a ball, followed by bunting a ball, then hitting a ball, then visually tracking one or more balls again, etc., for any combination that may provide superior efficacy in ocular enhancement and hitting for a particular individual, both subjectively and objectively, such as determined by a trainer.

In still other embodiments, the pitching product or apparatus described above may be used for tennis practice in ocular enhancement of a player for better accuracy in successfully returning balls, for use with or without a net. The inventive pitching product may also be sized accordingly to propel ping pong balls or any size of ball at a variety of speeds for ocular enhancement of a player of that sport or in other exercises in similar manner as above.

In yet additional aspects of the present invention, the inventive ocular enhancement method, products for use therewith, inclusive of the inventive pitching apparatus, practice bats and practice balls, provide for distinct business advantages heretofore unavailable, and may be employed as subject matter in conjunction with any of a number or array of different methods of conducting business. Such novel business methods employing the inventive subject matter include, without limitation, manufacturing, designing, marketing, selling, licensing, and/or leasing endeavors, or using the incentive subject matter to develop business good will or valuable trade mark rights, or perhaps as novel subject matter for any business entity formation, such as a partnership or corporation and the like.

While this invention has been described in connection with what is presently considered to be the most practical and preferred embodiments, it is to be understood that the invention is not to be limited in any way to the disclosed embodiments, as such are merely set forth for illustrative purposes only. The present inventive method, products and methods of conducting business in general are intended to cover an array of various modifications and equivalent arrangements, all of which are contemplated for inclusion within the scope and spirit of the disclosure and appended claims.

We claim:

1. A method for training a user of an activity in which one or more objects are projected towards the user, away from the user, or at some angle by the user at differing velocity ranges comprising:

a. projecting a set of objects towards, away from or at an angle by the user at a first velocity range, b. projecting a set of objects towards, away from or at an angle by the user at a second velocity range greater than the first velocity range, and effective to enhance the ocular focus of the user as to the projected objects in the second velocity range, and c. wherein steps (a) and (b) are carried out in substantially continuous succession within each velocity range and from one velocity range to another, and being performed in a session comprising an object being projected from about every 2 seconds to about every 60 seconds with a total of from about 2 objects to about 10,000 objects;

and further comprising the use of an air actuated projecting apparatus effective for propelling balls at timed intervals and at selected velocities which comprises:

a bin for holding a plurality of balls;

an air source for generating air pressure;

means for periodically selecting one of said plurality of balls, said means for selecting in communication with said bin;

means for dispensing said balls said means having a ball-entry area and a ball exit area, and wherein the entry area is contiguous to said means for selecting, and receiving each periodically selected ball from said bin;

means for delivering a ball from the exit area of the means for dispensing to a pressurizable ball propelling area comprising:

a restricting means including an adjustable annular orifice formed of plurality of semicircular portions which allow a user to control the degree to which the orifice is opened or closed; and a barrel means having first and second ends, and contiguous with the restricting means at the first end for receiving a ball propelled through the restricting means, and in which said barrel means is effective for shooting a ball propelled through the means for restricting and seating from its second end in a trajectory.

2. The method of claim 1 wherein step (b) is followed by an additional step in projecting a third set of objects towards, away from or at an angle by the user at a third velocity range selected from that of lower than the second velocity range and within the first velocity range, and effective to enhance the ocular focus of the user as to projected objects in the third velocity range.

3. The method of claim 1 wherein the second velocity range is from about 2 to about 100 miles per hour higher than the first velocity range.

4. The method of claim 1 wherein the second velocity range is from about 5 to about 15 miles per hour higher than the first velocity range.

5. The method of claim 2 wherein the second and/or third velocity range is from about 2 to about 100 miles per hour higher and/or lower than the first velocity range.

6. The method of claim 1 comprising the use of a baseball training bat, which comprises a barrel portion having first and second ends, with a first end having a handle portion and an second end having a ball striking portion, and wherein a portion of said ball striking portion is substantially larger in diameter than said second portion.

7. The method of claim 2 comprising the use of a baseball training bat, which comprises a barrel portion having first and second ends, with a first end having a handle portion and an second end having a ball striking portion, and wherein a portion of said ball striking portion is substantially larger in diameter than said second portion.

8. A method for training a user of an activity in which one or more objects are projected toward the user, away from the user, or at an angle by the user at differing velocity ranges comprising projecting a set of objects towards, away from at an angle by the user in sets of a plurality of incrementally increasing velocity ranges, wherein said incrementally increasing velocity ranges are increased from about 2 to about 100 miles per hour per set of projected objects and effective to enhance the ocular focus of the user as to projected objects in each velocity range, and wherein objects are projected in substantially continuous succession within each velocity range and from one velocity range to another at frequencies of projection from about every 2 seconds to about every 120 seconds with a total of from about 2 to about 10,000 objects;

and further comprising the use of an air actuated projecting apparatus effective for propelling balls at timed intervals and at selected velocities which comprises;

a bin for holding a plurality of balls;

an air source for generating air pressure; means for periodically selecting one of said plurality of balls, said means for selecting in communication with said bin;

means for dispensing said balls said means having a ball-entry area and a ball exit area, and wherein the entry area is contiguous to said means for selecting, and receiving each periodically selected ball from said bin;

means for delivering a ball from the exit area of the means for dispensing to a pressurlizable ball propelling area comprising a restricting means including an adjustable annular orifice formed of plurality of semicircular portions which allow a user to control the degree to which the orifice is opened or closed; and a barrel means having first and second ends, and contiguous with the restricting means at the first end for receiving a ball propelled through the restricting means, and in which said barrel means is effective for shooting a ball propelled through the means for restricting and seating from its second end in a trajectory.

9. The method of claim 8 further compromising interdispensed steps of projecting sets of objects at incrementally decreasing velocities ranges of from about 2 to about 1000 miles per hour set of projected objects in substantially continuous succession within each velocity range and from one velocity range to another.

10. The method of claim 8 wherein frequencies of projected objects are maintained constant for a set of projected objects comprising from about 2 to about 50 objects.

11. The method of claim 9 wherein frequencies of projected objects are maintained constant for a set of projected objects comprising from about 1 to about 50 objects.

12. The method of claims 1, 2 or 8, wherein the activity is selected from any type of ball hitting and contact and object hitting and contact.

13. The method of claim 12, wherein the activity is selected from one of baseball hitting, baseball fielding, tennis, badminton, football catching, soccer ball kicking, catching, head butting and fielding, ping pong, air-hockey, hockey, basketball rebounding, skeet shooting, and firearms shooting.

14. The method of claim 8 comprising the use of a baseball training bat, which comprises a barrel portion having first and second ends, with a first end having a handle portion and an second end having a ball striking portion, and wherein a portion of said ball striking portion is substantially larger in diameter than said second portion.

15. An air-actuated projecting apparatus effective for propelling balls at timed intervals and at selected velocities comprising:

a bin for holding a plurality of balls;

an air source for generating air pressure;

means for periodically selecting one of said plurality of balls, said means for selecting in communication with said bin;

means for dispensing said balls said means having a ball entry area and a ball exit area, and wherein the entry area is contiguous to said means for selecting for, and receiving each periodically selected ball from said bin;

a means for delivering a ball from the exit area of the means for dispensing to a pressurizable ball propelling area comprising a restricting means including an adjustable annular orifice formed of plurality of semicircular portions which allow a user to control the degree to which the orifice is opened or closed; and a barrel means having first and second ends, and contiguous with the restricting means at the first end for receiving a ball propelled through the restricting means, and in which said barrel means is effective for shooting a ball propelled through the means for restricting and seating from its second end in a trajectory.

* * * * *